United States Patent [19]

Chapman

[11] 3,960,100

[45] June 1, 1976

[54] PRESSURIZED SHIP STRUCTURE FOR SLAMMING LOADS

[75] Inventor: Richard B. Chapman, Reston, Va.

[73] Assignee: The United States of America as represented by the Secretary of the Navy, Washington, D.C.

[22] Filed: June 2, 1975

[21] Appl. No.: 583,083

[52] U.S. Cl. ..... 114/61; 114/.5 D; 114/43.5 R

[51] Int. Cl.[2] ..... B63B 1/10

[58] Field of Search ..... 114/.5 D, 61, 43.5 R, 114/43.5 AC, 219, 67 R, 67 A

[56] References Cited

UNITED STATES PATENTS

| | | | |
|---|---|---|---|
| 2,841,107 | 7/1958 | Scheider | 114/43.5 AC |
| 3,621,932 | 11/1971 | Tattersall et al. | 114/67 A |
| 3,673,975 | 7/1972 | Strauss | 114/43.5 R |
| 3,815,536 | 6/1974 | Duc | 114/.5 D |
| 3,842,772 | 10/1974 | Lang | 114/61 |

*Primary Examiner*—Trygve M. Blix
*Assistant Examiner*—Stuart M. Goldstein
*Attorney, Agent, or Firm*—Richard S. Sciascia; Ervin F. Johnston; Thomas Glenn Keough

[57] ABSTRACT

The underside of a semisubmerged ship or catamaran-type vessel's platform is protected from the slamming loads created by impacting waves. Elongate flexible chambers are fashioned from a flexible fabric and are arranged in a side-by-side relationship on the platform's bottom. The flexible chambers first resiliently absorb the forces of the impacting waves and then translate these forces into tensile stresses borne by interposed, rigid, structural members. The flexible fabric chambers and rigid structural members do not overly load the platform yet do provide a higher degree of protection for the platform.

6 Claims, 4 Drawing Figures

PRESSURIZED SHIP STRUCTURE FOR SLAMMING LOADS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Recent innovations have made high speed ships a reality. Semisubmerged ships of the types described in U.S. Pat. Nos. 3,623,444 and 3,730,123 are capable of sustained high speed operation, yet they tend to be vulnerable to the effects of unusually high waves. When unusually high waves strike their relatively large platforms, the slamming loads might deform the underside plates. Even the well known catamaran-type vessel is subject to such battering when waves hit the underside of the structure bridging the two hulls. As with the semisubmerged ship design, the impacting forces not only damage the boat but buffet the occupants and anything on board. Such abuse is reduced by slowing the rate of travel, but this precautionary step compromises these ships' high speed capability. One noteworthy attempt to remedy this unsatisfactory situation is disclosed in U.S. Pat. No. 3,842,772 issued to Thomas G. Lang entitled "High Speed Ship with Bow Impact Alleviator." This patent discloses, among other things, cusp shaped projections on the underside of the platform which hydrodynamically cooperate with impacting waves to create internal tensile stresses. This design did lessen the effect of the slamming waves and has been incorporated into a prototype currently undergoing extensive testing and evaluation. To date, there have been indications that additional compensation for the slamming effect of large waves may be desirable. Thus, there is a continuing need in the state of the art for structural modifications for a semisubmerged ship or a catamaran type craft which reduces the effect of impacting waves, yet does not overly add to the vessel's weight or bulk.

SUMMARY OF THE INVENTION

The present invention is directed to providing an improvement for a semisubmerged ship having a laterally extending platform supported above the water's surface by at least one water surface piercing strut member mounted on at least one elongate hull. A plurality of side-by-side, flexible panels is interconnected to define a number of pressurized juxtaposed, flexible chambers on the bottom of the semisubmerged ship's platform. The bottom panels have a generally semicircular, cross-sectional configuration to resiliently absorb the slamming loads of the impacting waves. Another set of flexible panels having opposing semicircular cross-sectional configurations translate the impacting forces into internal tensile stresses. These stresses are transmitted to rigid structural members disposed between adjacent elongate chambers.

Therefore, it is a prime object of the invention to provide an improvement for ocean going ships.

Yet another object is to provide a lightweight, modification for a semisubmerged ship giving the ship increased seaworthy capabilities.

Another object of the invention is to provide structure for absorbing the force of impacting waves and translating the slamming loads into internal tensile stresses.

Still another object is to provide a number of flexible, elongate chambers on the underside of a semisubmerged ship's platform which do not overly compromise the ship's pay load.

A further object is to provide flexible chambers formed of a pair of opposing flexible panels coupled to rigid structural members for absorbing, translating and transmitting the slamming loads of impacting waves to the ship's platform.

These and other objects of the invention will become more readily apparent from the ensuing specification when taken with the drawings.

DESCRIPTION OF THE PREFERRED EMBODIMENT

Figure 1:
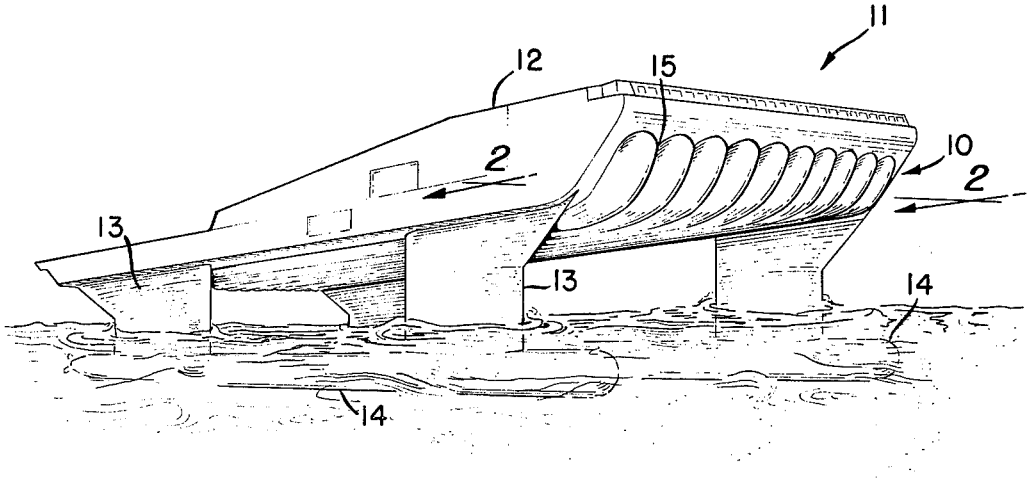
FIG. 1 shows the invention operatively installed on a representative embodiment of a semisubmerged ship.
Figure 2:
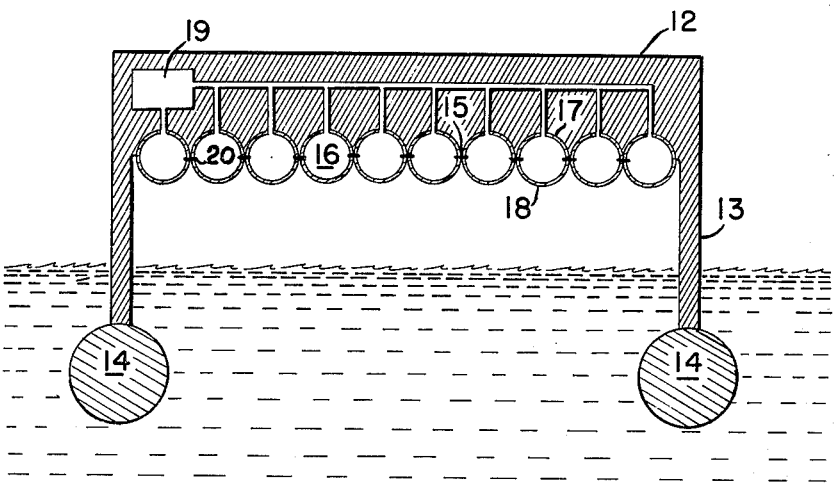
FIG. 2 shows a schematic representation of the invention taken generally along lines 2—2 in FIG. 1.

Referring now to the drawings, FIG. 1 shows a representative embodiment of a pressurized assembly 10 operatively disposed on the underside of a semisubmerged ship 11. For the purpose of disclosing a specific example, the semisubmerged ship optionally is of the type fully disclosed in U.S. Pat. No. 3,623,444. A platform 12 is held above the water surface by several water surface piercing strut members 13, reaching up from elongate hulls 14.

On this representative embodiment of the invention, the bow and underside of the platform are modified to include cusp-shaped bow impact alleviators 15. These alleviators are shaped in accordance with the teachings of U.S. Pat. No. 3,842,772 and as such they partially translate a wave's impacting forces to internal tensile stresses. This modification of the platform is not critical to reap the advantages of this invention, however, but it was herein relied upon to demonstrate how this invention can supplement the capabilities of one of the most recent advances of the state of the art.

To this end, a plurality of elongate chambers 16 are arranged in a side-by-side relationship on the underside of the semisubmerged ship. The chambers are contained by a flexible, upper panel 17 and a flexible, lower panel 18. The panels optionally are a fabric-like material, for example, a rubber impregnated canvas or a more sophisticated synthetic reinforced with glass or metal fibers. The fiber reinforced design is the more likely candidate, since the finely drawn strands inherently possess superior tensile strengths while having a sufficient flexibility to allow their being flexed.

A source of pressurized gas 19 is connected to each of the chambers and feeds pressurized gas to them. The exact magnitude is variable depending on the size of the craft and the size and type of waves that are expected. In any event, there is a sufficient pressure to distend the chambers to assume an essentially circular, cross-sectional configuration.

A rigid structural member 20 is disposed at diametrically opposed locations on each of the chambers and serves to connect the chambers to the platform. Optionally, the rigid structural members are located adjacent or affixed to apexes of cusp-shaped projections 15 to transfer the impacting load onto the ship.

Figure 3:
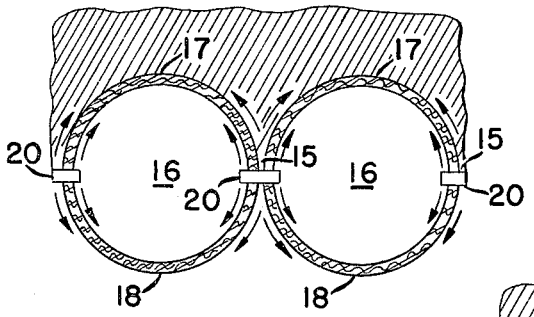
FIG. 3 schematically depicts the force elements in a flexible chamber and the rigid structural members before an impact.

Noting FIG. 3, flexible upper panel 17 and flexible lower panel 18 are shown in a fully distended state before impact. The internal pressure in each chamber causes a tension in the upper panel and a tension in the lower panel which are equal in magnitude and mutually cancelling. A positive gauge pressure is essential or else both panels would sag ineffectually and not functionally cooperate to transform the slamming loads into internal tensile forces.

Figure 4:
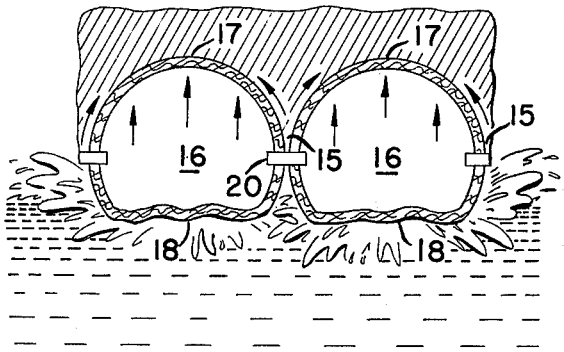
FIG. 4 shows the force relationships during impact.

Looking to FIG. 4, the lower flexible panel is deformed by an impacting high wave. Its internal tensile stresses are reduced and it compliantly accommodates the wave.

On the other hand, the internal stresses in upper flexible panel are greater since the reduced volume of chamber 16 creates higher pressures. These higher pressures are contained by upper panel 17 which develops higher tensile stresses.

The increased tensile stresses in the upper panels and the reduced tensile stresses in the lower panels are transmitted as a net tensile force to rigid structural members 20 and to the platform. Thus, the entire bottom can be protected at a cost of having only a relatively modest weight increase of the flexible panels and the rigid members.

The impact resisting capability of this invention has demonstrated, that it augments the cusp-shaped projections on a semisubmerged ship. The invention can be adapted to any number of craft to protect them from the slamming effects of large waves.

Obviously, many modifications and variations of the present invention are possible in the light of the above teachings, and, it is therefore understood that the invention may be practiced otherwise than as specifically described.

What is claimed is:

1. In a semisubmerged ship having a laterally extending platform supported above the water's surface by at least one water surface piercing strut member mounted on at least one elongate hull, an improvement therefor for reducing the effects of impacting waves is provided comprising:

means carried on the underside of the laterally extending platform for resiliently absorbing the slamming loads of impacting waves;

means carried on the underside of the laterally extending platform and upwardly of the resiliently absorbing means for pneumatically translating the slamming loads into tensile stresses; and means coupled between the resiliently absorbing means and the pneumatically translating means for transmitting the tensile stresses to the platform.

2. An improved semisubmerged ship according to claim 1 in which the resiliently absorbing means is a plurality of first elongate flexible panels having a semicircular cross-sectional configuration.

3. An improved semisubmerged ship according to claim 2 in which the pneumatically translating means is a plurality of second elongate flexible panels cooperating with the first elongate flexible panels to form a plurality of elongate chambers.

4. An improved semisubmerged ship according to claim 3 further including:

a source of pressurized gas coupled to the elongate chambers for pressurizing same.

5. An improved semisubmerged ship according to claim 4 in which the means for transmitting is a plurality of rigid structural members secured to the platform and coupled to the first elongate flexible panels and the second flexible elongate panels.

6. An improved semisubmerged ship according to claim 5 in which individual ones of the rigid structural members are interposed between adjacent elongate chambers at diametrically opposed locations.

* * * * *